US006439021B1

(12) United States Patent
Langeder et al.

(10) Patent No.: US 6,439,021 B1
(45) Date of Patent: Aug. 27, 2002

(54) DEVICE FOR VERTICALLY DISPLACING A ROLL RUNNING ON BEARINGS IN A ROLL STAND

(75) Inventors: Rudolf Langeder, Mauthausen; Sepp-Dieter Döltl, Vienna, both of (AT)

(73) Assignee: Voest-Alpine Industrieanlagenbau GmbH & Co., Linz (AT)

( * ) Notice: Subject to any disclaimer, the term of this patent is extended or adjusted under 35 U.S.C. 154(b) by 0 days.

(21) Appl. No.: 09/716,448

(22) Filed: Nov. 21, 2000

(30) Foreign Application Priority Data

Nov. 22, 1999 (AT) ..... 1981/99

(51) Int. Cl.[7] ..... B21B 31/30
(52) U.S. Cl. ..... 72/244
(58) Field of Search ..... 72/244, 248

(56) References Cited

U.S. PATENT DOCUMENTS 3,596,490 A * 8/1971 Willeke et al. ..... 72/244
3,805,573 A 4/1974 Petros et al.
5,479,809 A * 1/1996 Stachuletz et al. ..... 72/244

FOREIGN PATENT DOCUMENTS

DE C721951 5/1942
DE 3331479 3/1985
DE 3926544 2/1990

* cited by examiner

*Primary Examiner*—Lowell A. Larson
(74) *Attorney, Agent, or Firm*—Birch, Stewart, Kolasch & Birch, LLP

(57) ABSTRACT

In a device for vertically displacing a lower roll of a pair of rolls, running on bearings in a roll stand (1), for adjusting the upper side of the lower roll to the rolling line, the rolls run on bearings in chocks and optionally can be supported by supporting rolls likewise running on bearings in chocks. Said device comprises actuators (12) having supporting surfaces (15) and having mating supporting surfaces (16) arranged at different height levels in the direction of displacement, which selectively may be brought into and out of contact with the supporting surfaces (15), which actuators (12) are built in between the chocks of the lower roll and/or the chocks (8) of the lower supporting roll and the roll stand (1). For the purpose of achieving a considerable total height of adjustment and, at the same time, a height adjustment of the lower roll which is as fine as possible, each actuator (12) comprises two bushes (13, 14) which are relatively twistable against each other around an axis (A) oriented in the direction of displacement and which can be brought into and out of contact in the direction of the axis (A), one bush (13) having the supporting surfaces (15) and the second bush (14) having mating supporting surfaces (16) designed diametrically opposed to the supporting surfaces (15) (FIG. 4).

20 Claims, 4 Drawing Sheets

DEVICE FOR VERTICALLY DISPLACING A ROLL RUNNING ON BEARINGS IN A ROLL STAND

Figure 1:
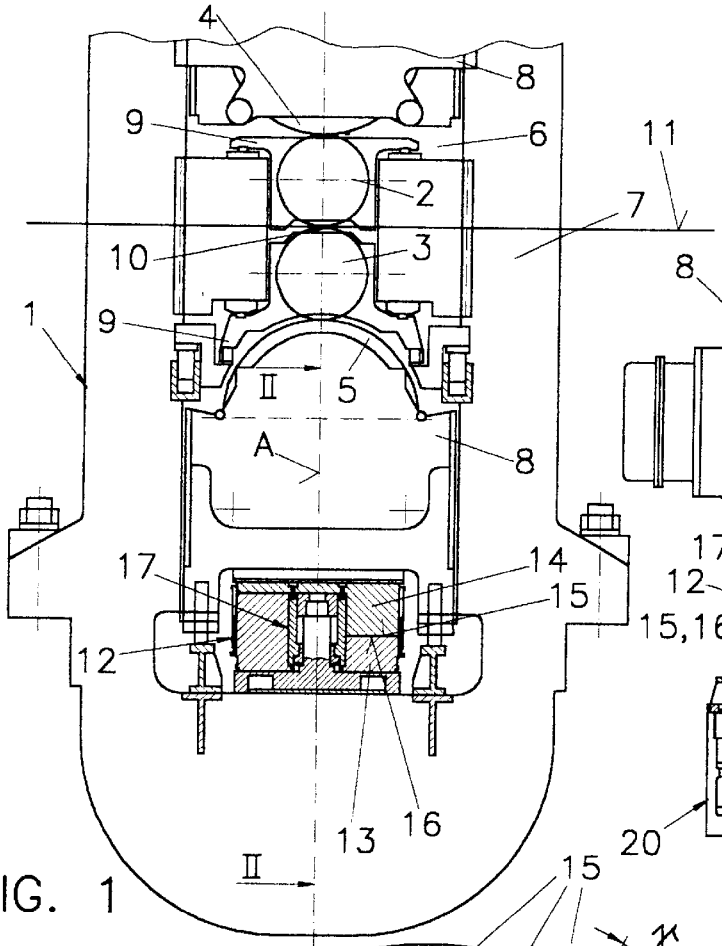

The invention relates to a device for vertically displacing a lower roll of a pair of rolls, running on bearings in a roll stand, for adjusting the upper side of that roll to the rolling line, wherein the rolls run on bearings in chocks and optionally can be supported by supporting rolls likewise running on bearings in chocks, which device comprises actuators having supporting surfaces and having mating supporting surfaces arranged at different height levels in the direction of displacement, which selectively may be brought into and out of contact with the supporting surfaces, which actuators are built in between the chocks of the lower roll and/or the chocks of the lower supporting roll and the roll stand.

A device of this kind is known for example from DE-A-1 33 31 479 and from DE-A-1 38 26 544.

According to the latter document, the actuator has a rotary disk, which acts on a pressure disk, wherein, depending on the torsion of the rotary disk, circular-ring segment surfaces provided on the rotary disk come to sit adjacent to circular-ring segment surfaces of the pressure disk or between them. Thereby, however, only two heights of adjustment for screwing down a roll to the rolling line are possible. For deviating heights of adjustment, the actuators would have to be changed.

According to DE-A-1 33 31 479, each actuator is constituted by a supporting component having a pair of fitting plates having two supporting surfaces and by an adjusting disk having mating supporting surfaces arranged at different heights and designed in the form of circular-ring segments, which adjusting disk runs on bearings on the roll stand, being pivotable against the supporting component. The two supporting surfaces of the supporting component sit adjacent to the mating supporting surfaces arranged on the pivotable adjusting disk, adjacent mating supporting surfaces being provided at different heights and mating supporting surfaces opposed in pairs being provided at the same height. Since the supporting surface must have a certain mimimum size to ensure a surface pressure being lower than the maximum admissible surface pressure, the mating supporting surfaces must also have a corresponding size, so that only few mating supporting surfaces sitting at different height levels are feasible. From this results a device which allows only few possibilities of adjustment. In order to ensure a considerable total height of adjustment all the same, only a very coarse adjustment of a roll to the rolling line is possible, i.e., the height graduations from mating supporting surface to mating supporting surface must be, on account of the small number of the same, relatively large to achieve a required minimum total height of adjustment.

The invention aims at avoiding these disadvantages and difficulties and has as its object to provide a device of the initially described kind, which allows, on the one hand, to ensure a considerable total height of adjustment and, on the other hand, to achieve a height adjustment of a roll to the rolling line which is as fine as possible. Here, particularly a very low specific surface pressure which is far below the maximum admissible surface pressure should be feasible.

According to the invention, this object is achieved in that each actuator comprises two bushes which are relatively twistable against each other around an axis oriented in the direction of displacement and which can be brought into and out of contact in the direction of the axis, one bush having the supporting surfaces and the second bush having mating supporting surfaces designed diametrically opposed to the supporting surfaces.

Preferably, one of the bushes is not twistable against the roll stand, and the second bush is twistable against the other bush and/or against the roll stand.

To be able to twist the bushes relatively to each other in a simple way even when the supporting surfaces and mating supporting surfaces are arranged in steps, suitably one of the bushes can be, by means of a pressure-medium cylinder, elevated and lowered against the other bush in the direction of displacement; preferably, the bush which is not twistable against the roll stand can be elevated and lowered, whereas the bush which is twistable against the roll stand is, with regard to height, fixed relative to the roll stand, and, furthermore, a pressure-medium cylinder arranged centrally in the corresponding second bush is provided for elevating and lowering a bush.

Suitably, both the supporting surfaces and the mating supporting surfaces are arranged in a helical form and make up a thread extending over 360° . Here, the thread is divided into two sections having each an angle at circumference of 180°, so that the maximum height of adjustment is half of the lead.

A preferred embodiment is characterized in that the supporting surfaces and mating supporting surfaces are arranged in a helical form and are designed as extending two times over an angle at circumference of 180°, respectively, and thus form half a thread, respectively, wherein both half threads sit at the same height, which ensures a symmetrical load on both bushes in each of their positions.

For smaller relative torsions of the bushes against each other it is suitable if the twistable bush is pivotable by means of a pressure-medium cylinder supported by the roll stand on the one hand and the bush on the other hand.

For bigger angles of torsion of the bushes against each other it is suitable if the pivotable bush on its circumferential side is provided with an annular-gear segment in which a pinion motor engages.

A particularly preferred embodiment is characterized in that the pivotable bush is provided with an annular-gear segment on its circumferential side and that a toothed rack, which is movable in the longitudinal direction by means of a pressure-medium cylinder, can be engaged in and/or disengaged from the annular-gear segment.

Preferably, the supporting surfaces and mating supporting surfaces are constituted by element surfaces which are arranged staggered with regard to height in the form of a winding staircase, the element surfaces advantageously being oriented vertically to the rotation axis of the bushes.

However, it is also possible to arrange the element surfaces as being inclined relative to the rotation axis of the bushes.

To achieve a bearing area of the supporting surfaces and mating supporting surfaces which is as large as possible, the element surfaces are designed in the form of circular-ring segments.

Another preferred embodiment is characterized in that the supporting surfaces and mating supporting surfaces are constituted by surfaces forming identical teeth, respectively, wherein the teeth of both the supporting surface and the mating supporting surface are arranged along a screw-shaped surface having the same gradient and can be engaged under formation of a gear-tooth system, and wherein the gear-tooth system is advantageously designed as a serration. When the gear-tooth system has a fine design, the present embodiment makes it possible to achieve a very fine height adjustment of the roll to the rolling line.

To achieve the possibility of continuous adjustment of the roll to the rolling line, suitably the supporting surfaces and mating supporting surfaces are designed as screw-shaped sliding surfaces, respectively, which have the same gradient, the angle of inclination being smaller than the corresponding angle of friction.

Advantageously, a torsion lock against unintended relative twisting of the two bushes is provided here in addition to the supporting surfaces and mating supporting surfaces, preferably formed by teeth on one of the bushes, which engage in counter-teeth on the second bush, which corresponds to said bush, the teeth being provided on the side of the outer circumference of the bushes.

The invention further comprises a roll stand with two working rolls, which is equipped with an inventive device for vertically displacing rolls running on bearings in a roll stand, for adjusting the upper edge of the lower roll of a pair of rolls to the rolling line. That roll stand suitably has working rolls which can be supported by supporting rolls.

In the following, the invention will be explained in more detail by way of several exemplary embodiments illustrated in the drawings, wherein FIG. 1 shows a partly sectional side view of a roll stand, and FIG. 2 a section along the line II—II of FIG. 1, according to a first embodiment.

Figure 3:
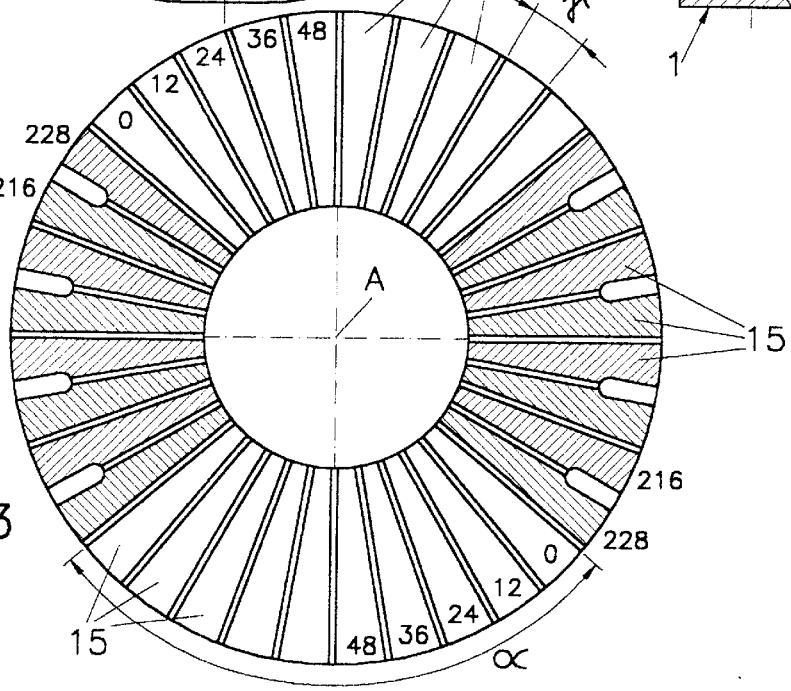

FIG. 3 renders a top view of a bush according to the inventive device.

Figure 2:
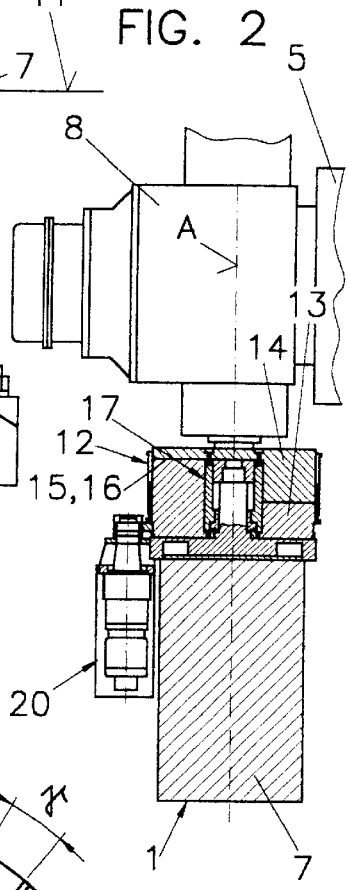
Figure 4:
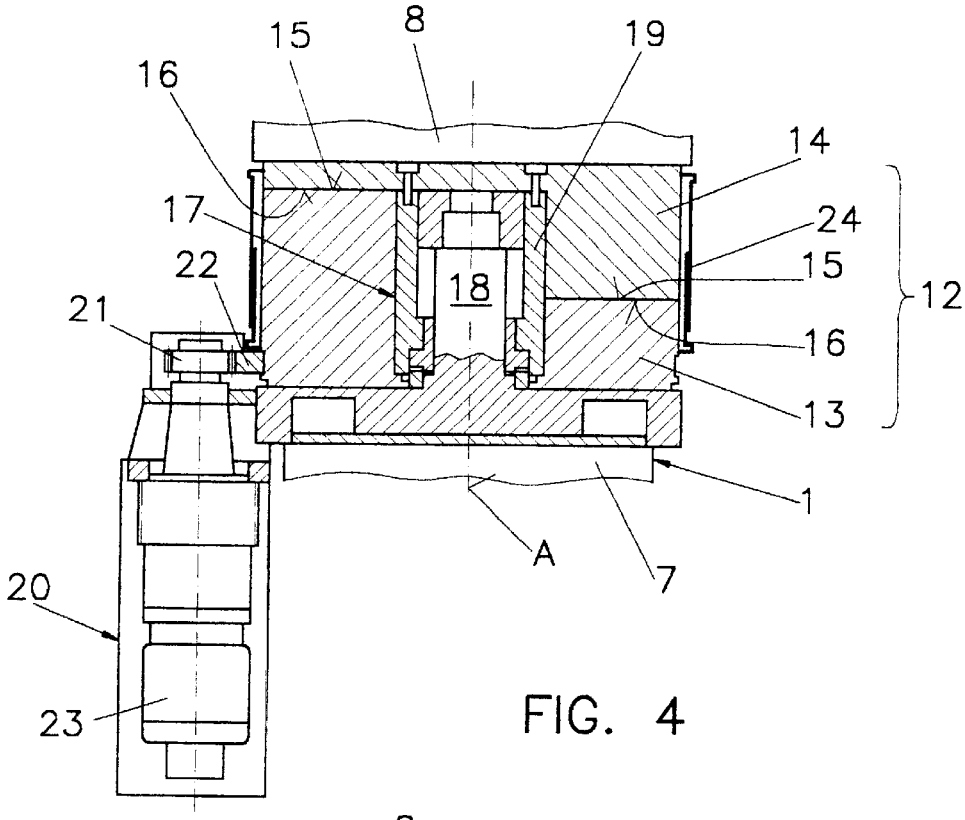
Figure 5:
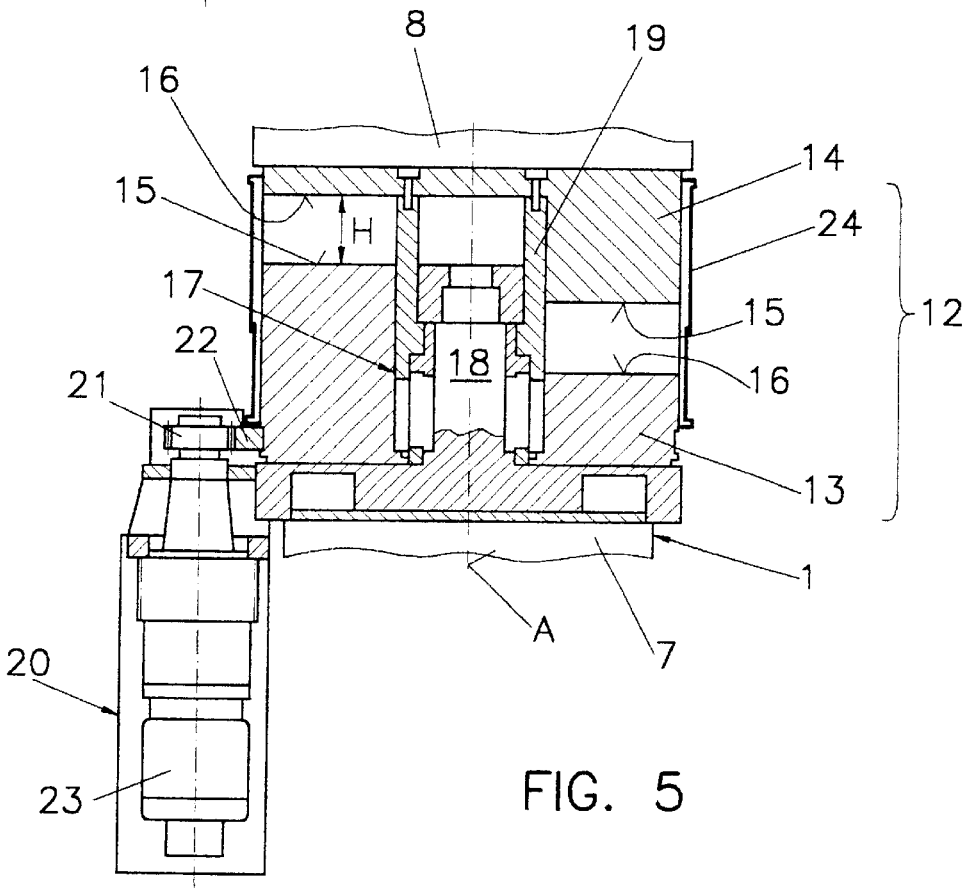
Figure 6:
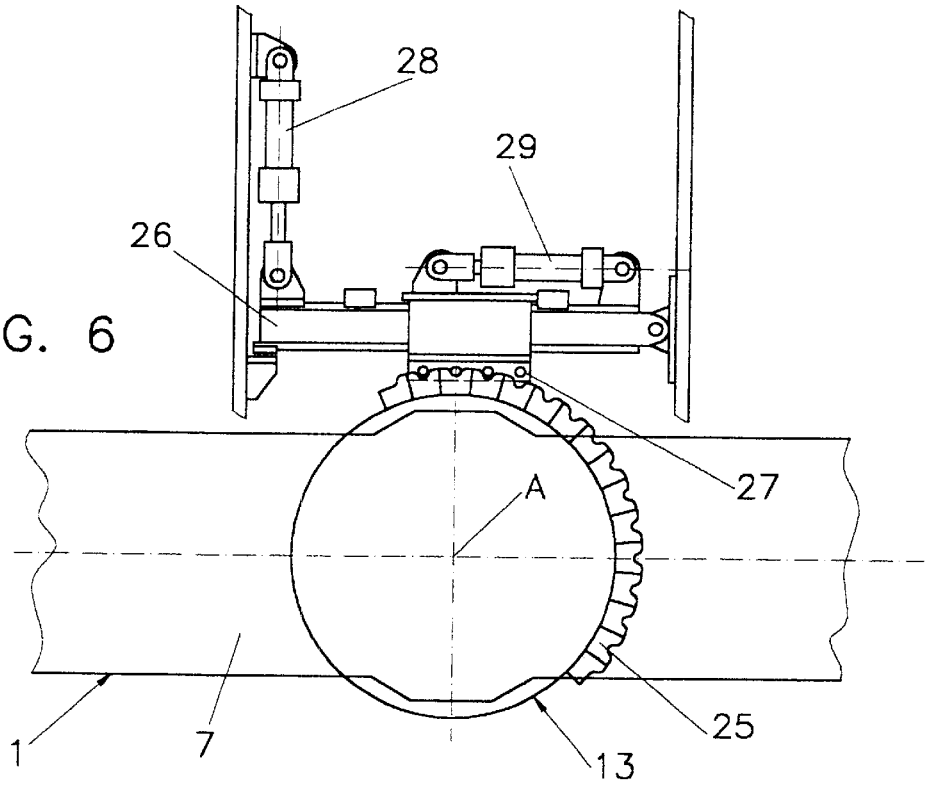
Figure 7:
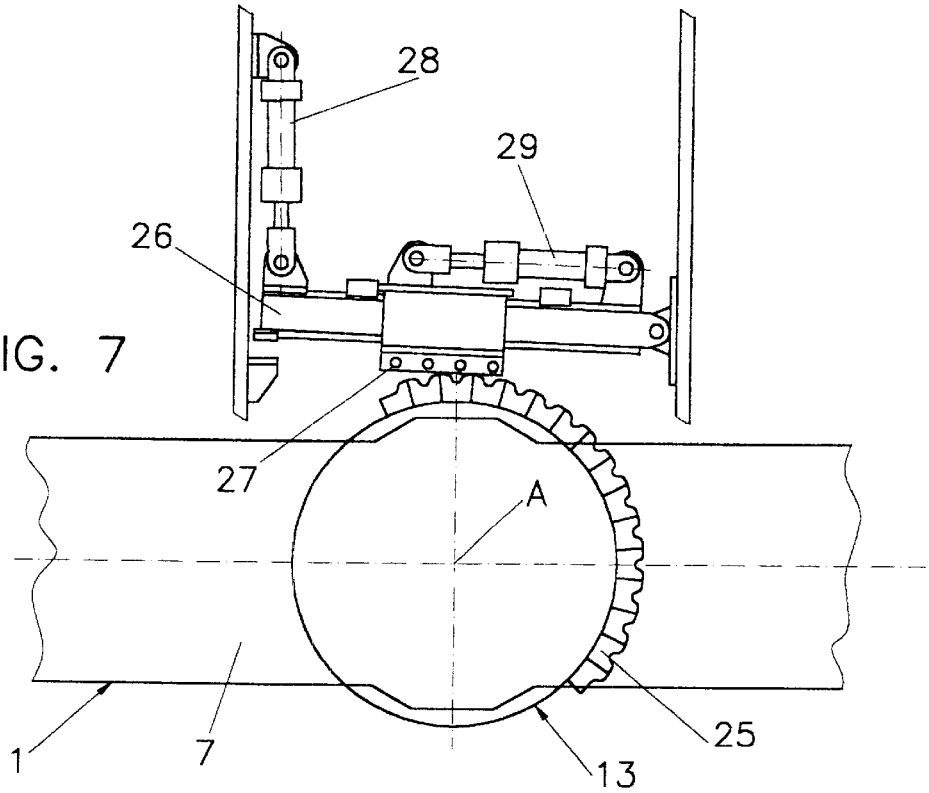

FIGS. 4 and 5 each show a section through an inventive device according to FIG. 2 on an enlarged scale, and FIGS. 6 and 7 each illustrate a top view of another embodiment of an inventive device in diagrammatic representation.

Figure 8:
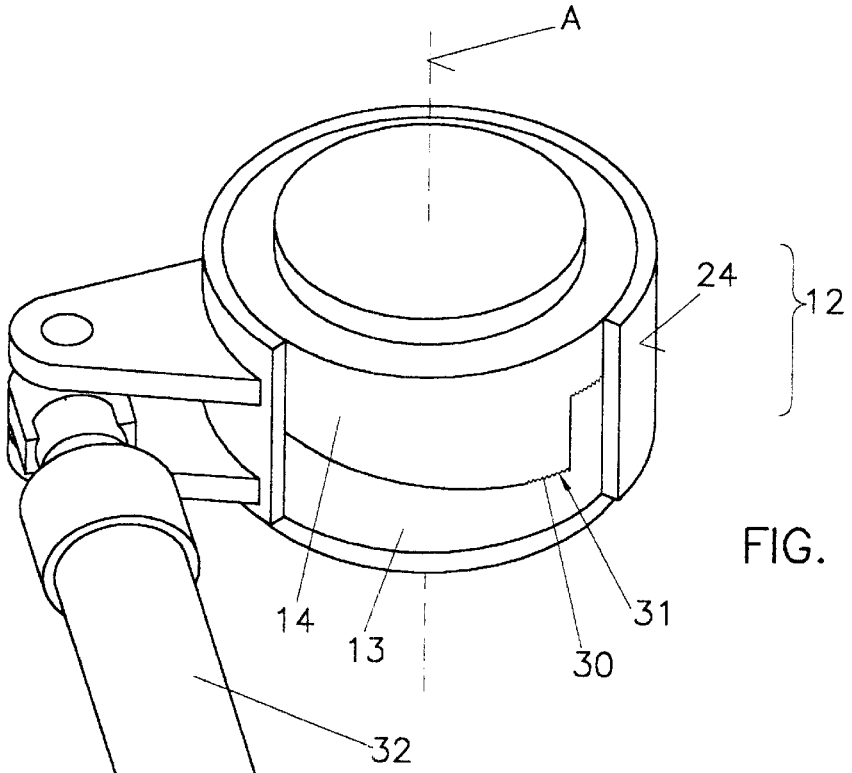
Figure 9:
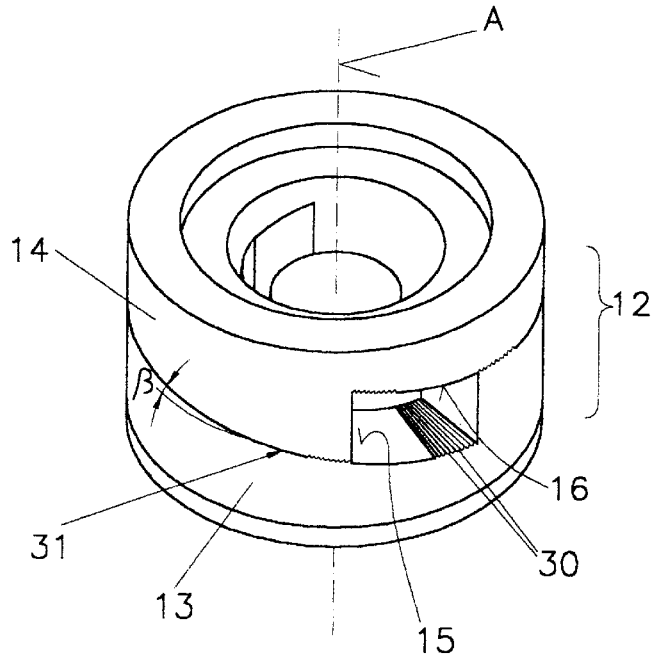

FIGS. 8 and 9 show another embodiment of a device according to the invention, likewise in diagrammatic representation, in an oblique view.

FIG. 1 illustrates a four-high roll stand 1, the working rolls 2, 3 of which can be supported by supporting rolls 4,5. Both the working rolls 2, 3 and the supporting rolls 4, 5 at both ends in window openings 6 are guided, in a usual way by means of chocks 8, 9, by two roll posts 7 of the roll stand 1, which roll posts are arranged at the ends of the rolls, respectively. To adjust the lower working roll 3 to the rolling line 11 by its upper side 10, i.e., its uppermost generatrix, the supporting roll 5 corresponding to that working roll 3 is vertically adjustable. For this purpose, an actuator 12 is arranged between the chock 8 of that supporting roll 5 and the lower end of the window opening 6 of each roll post 7, which actuator comprises two bushes 13, 14 arranged concentrically around an axis A, which bushes are provided with supporting surfaces 15 and mating supporting surfaces 16 arranged at different height levels, respectively, at least a portion of the mating supporting surfaces 16 being supported by the supporting surfaces 15, and the chocks 8 being supported by the actuators 12, during operation of the roll stand 1.

Both the supporting surfaces 15 and the mating supporting surfaces 16 are constituted by element surfaces in the form of circular-ring segments, which have the same size and are arranged around the axis A (see FIG. 3), and which are arranged in the form of a winding staircase and, by the same distance, respectively, staggered relative to each other with regard to height; the arrangement having the form of a winding staircase extends two times over an angle at circumference of 180° of a bush 13 and 14, respectively, so that adjacent element surfaces sit staggered with regard to height, and element surfaces diametrically opposed to each other around axis A sit at the same height. FIG. 3 represents the element surfaces forming the supporting surfaces 15, the numbers indicated on the element surfaces rendering the height levels of the element surfaces in mm, starting from the height level of the element surface designated by "0".

Each of the lower bushes 13 is, with regard to the roll stand, arranged to be twistable around axis A, whereas the respective upper bush 14 is, with regard to the roll stand 1, fixed against twisting, but can be adjusted in height, namely by means of a pressure-medium cylinder 17 arranged centrally in the lower bush. The bush 14, which is arranged coaxially to the bush 13, can be adjusted in height along axis A. Thus, axis A also indicates the direction of displacement, in which the working roll 3 is adjustable in height.

The pressure-medium cylinder 17 has a central guide pin 18, along which an annular piston 19 can be shifted. That annular piston 19 by its upper end is supported centrally by the upper bush 14 in a recess of the same. FIG. 4 shows the lowered state, and FIG. 5 the elevated state of the upper bush 14. The maximum elevation H of the upper bush 14 which is possible by means of the pressure-medium cylinder 17 is somewhat higher than the maximum height of adjustment of the supporting roll 5 and/or the working roll 3.

According to the embodiments represented in FIGS. 1, 2 and 4, and 5, a slewing gear 20 is provided for twisting the lower bush 13, which, on account of the winding-staircase-like arrangement of the element surfaces 15 and 16, can be accomplished only in the elevated state of the upper bush 14; the driving pinion 21 of the slewing gear engages in a circumferential gear-tooth system 22, designed as an annular-gear segment, of the lower bush 13. The slewing motion is controlled by using a slew-imparting means on the motor 23.

According to the winding-staircase-like arrangement of the element surfaces 15 and 16, which extends two times over an angle at circumference of 180°, respectively, the two bushes 13 and 14 form half a thread, i.e., the maximum relative torsion of the two bushes 13 and 14 against each other is limited to 180°. When the bushes 13 and 14 are in contact, more or fewer mating supporting surfaces 16 come to sit adjacent to the supporting surfaces 15, depending on the angle of torsion. To ensure a safe rest where the surface pressure is not too high, the actual maximum angle of torsion a is limited to less than 180°; in the represented exemplary embodiment, to a maximum of 12×9°, which corresponds to a maximum torsion of 108°, each of the element surfaces 15 and 16 extending over an aperture angle ± of 9°

In the represented exemplary exemplary embodiment, the height difference between adjacent circular-ring segment surfaces 15 and 16 are 12 mm, respectively, so that a maximum height of adjustment of 144 mm results. The element surfaces 15 which are hatched in FIG. 3 render the bearing area of the upper bush 14 on the lower bush 13, which remains when the bushes 13 and 14 (at the highest height of the actuator 12) undergo the maximum torsion, i.e., sixteen mating supporting surfaces 16 and/or element surfaces 16 are supported by sixteen supporting surfaces 15 and/or element surfaces 15.

The element surfaces 15 and 16 are protected against fouling by a housing 24, which preferably comprises both bushes. Preferably, the housing 24 is constituted by two sleeves which engage more or less telescopically in each other, depending on the angle of torsion a and thus on the set height of the supporting roll 5.

FIGS. 6 and 7 give another drive variant for twisting the lower bush 13. The pivotable bush 13 has a gear-tooth system on the circumferential side as well, namely an annular-gear segment 25. In that annular-gear segment, a toothed rack 27 which is arranged to be shiftable along a swivelling guide 26 engages, pressure-medium cylinders 28, 29 being provided for both swivelling the guide 26 and shifting the toothed rack 27, respectively. FIG. 6 shows the engagement position of the toothed rack 27 in the annular-gear segment 25, in which twisting of the bush 13 may take place; FIG. 7 shows the disengagement position.

According to the embodiment of the bushes 13 and 14 which is represented in FIGS. 8 and 9, the supporting surfaces 15 and mating supporting surfaces 16 are constituted by teeth 30, respectively, the teeth 30 engaging in each other at upper bush 14 supported by lower bush 13 and forming a gear-tooth system 31, preferably a serration. Here, the supporting surfaces 15 and mating supporting surfaces 16 are likewise arranged in a helical form and likewise extend two times over an angle at circumference of 180°. In FIGS. 8 and 9, the teeth 30 are illustrated only over a short bend of the bushes 13 and 14.

The gear-tooth system 31 makes it possible to realize very steep wedge angles β for the helical arrangement of the teeth 30, so that despite the possibility of fine adjustment very large maximum areas of displacement result for the supporting roll 5 and thus the working roll 3.

According to the embodiment represented in FIGS. 8 and 9, the lower bush 13 can be twisted by means of a pressure-medium cylinder 32, which is hinged upon the bush 13 on the one hand and upon the roll post 7 on the other hand.

The invention is not limited to the embodiments represented in the drawings, but may be modified in various respects. It is, for instance, possible to design the supporting surfaces 15 and mating supporting surfaces 16 as screw-shaped sliding surfaces having an angle of inclination (wedge angleβ) which is smaller than the corresponding angle of friction. In such an embodiment, it is, however, suitable to provide a torsion lock for locking the respective twisting position of the bushes 13 and 14 relative to each other. That torsion lock may be constituted for instance by a gear-tooth system arranged on the outer side, i.e., the circumferential side of the bushes 13 and 14.

What is claimed is:

1. A device for vertically displacing a lower roll of a pair of rolls, running on bearings in a roll stand, for adjusting the upper side of that roll to the rolling line, wherein the rolls run on bearings in chocks and supported by supporting rolls likewise running on bearings in chocks, which device comprises actuators having supporting surfaces and having mating supporting surfaces arranged at different height levels in the direction of displacement, which selectively may be brought into and out of contact with the supporting surfaces, which actuators are built in between at least one of the chocks of the lower roll and/or the chocks of the lower supporting roll and the roll stand, characterized in that each actuator comprises two bushes which are relatively twistable against each other around an axis oriented in the direction of displacement and which are movable into and out of contact in the direction of the axis, one bush having the supporting surfaces and the second bush having mating supporting surfaces designed diametrically opposed to the supporting surfaces.

2. A device according to claim 1, characterized in that one of the bushes is not twistable against the roll stand, and the second bush is twistable against at least one of the other bush or against the roll stand.

3. A device according to claim 1, characterized in that one of th e bushes can be, by means of a pressure-medium cylinder, elevated and lowered against the other bush in the direction of displacement.

4. A device according to claim 3, characterized in that the bush which is not twistable against the roll stand can be elevated and lowered, whereas the bush which is twistable against the roll stand is, with regard to height, fixed relative to the roll stand.

5. A device according to claim 3, characterized in that a pressure-medium cylinder arranged centrally in the corresponding second bush is provided for elevating and lowering a bush.

6. A device according to claim 1, characterized in that both the supporting surfaces and the mating supporting surfaces are arranged in a helical form and make up a thread extending over 360°.

7. A device according to claim 1, characterized in that both the supporting surfaces and the mating supporting surfaces are arranged in a helical form and are designed as extending two times over an angle at circumference (α) of 180°, respectively, and thus form half a thread, respectively, wherein both half threads sit at the same height.

8. A device according to claim 1, characterized in that the twistable bush is pivotable by means of a pressure-medium cylinder supported by the roll stand on the one hand and the bush on the other hand.

9. A device according to claim 1, characterized in that the pivotable bush on its circumferential side is provided with an annular-gear segment in which a pinion motor engages.

10. A device according to claim 1, characterized in that a pivotable bush is provided with an annular-gear segment on its circumferential side and that a toothed rack, which is movable in the longitudinal directions by means of a pressure-medium cylinder, can be engaged in and/or disengaged from the annular-gear segment.

11. A device according to claim 1, characterized in that the supporting surfaces and mating supporting surfaces are constituted by element surfaces which are arranged staggered with regard to height in the form of a winding staircase.

12. A device according to claim 11, characterized in that the element surface are oriented vertically to the rotation axis of the bushes.

13. A device according to claim 11, characterized in that the element surfaces are arranged as being inclined relative to the rotation axis of the bushes.

14. A device according to claim 11, characterized in that the element surfaces are designed in the form of circular-ring segments.

15. A device according to claim 1, characterized in that the supporting surfaces and mating supporting surfaces are constituted by surfaces forming identical teeth, respectively, wherein the teeth of both the supporting surface and the mating supporting surface are arranged along a screw-shaped surface having the same gradient and can be engaged under formation of a gear-tooth system.

16. A device according to claim 15, characterized in that the gear-tooth system is designed as a serration.

17. A device according to claim 1, characterized in that the supporting surfaces and mating supporting surfaces are designed as screw-shaped sliding surfaces, respectively, which have the same gradient, the angle of inclination (β) being smaller than the corresponding angle of friction.

18. A device according to claim 17, characterized in that a torsion lock against unintended relative twisting of two bushes is provided in addition to the supporting surfaces and mating supporting surfaces, formed by teeth on one of the bushes, which engage in counter-teeth on the second bush, which corresponds to said bush, the teeth being provided on the side of the outer circumference of the bushes.

19. A roll stand having two working rolls, characterized by a device according to claim 1.

20. A roll stand according to claim 19, characterized in that working rolls can be supported by supporting rolls.

* * * * *